US007082714B1

(12) United States Patent
Behrens

(10) Patent No.: US 7,082,714 B1
(45) Date of Patent: Aug. 1, 2006

(54) LIGHT VASE

(76) Inventor: Thomas F. Behrens, One Hardwood Dr., Madison, NJ (US) 07940-2710

( * ) Notice: Subject to any disclaimer, the term of this patent is extended or adjusted under 35 U.S.C. 154(b) by 0 days.

(21) Appl. No.: 11/042,127

(22) Filed: Jan. 24, 2005

(51) Int. Cl.
*A47G 7/06* (2006.01)

(52) U.S. Cl. ..... 47/41.01

(58) Field of Classification Search ..... 47/41.11, 47/41.01, 81; 362/161, 294, 345; D11/144, D11/146; D26/10
See application file for complete search history.

(56) References Cited

U.S. PATENT DOCUMENTS

| | | | | |
|---|---|---|---|---|
| 1,001,096 | A | 8/1911 | Townsend | |
| 2,876,587 | A * | 3/1959 | Saks et al. | 47/41.11 |
| D200,720 | S * | 3/1965 | Hennig | D11/144 |
| 3,962,824 | A * | 6/1976 | Poston | 47/81 |
| 4,017,729 | A | 4/1977 | Frazier, Jr. | |
| 4,524,408 | A | 6/1985 | Minera | |
| 4,894,008 | A | 1/1990 | Lee | |
| 4,937,701 | A * | 6/1990 | Schroder | 362/161 |
| D388,892 | S | 1/1998 | Ratia | |
| D447,256 | S | 8/2001 | Ratia | |
| 6,315,433 | B1 | 11/2001 | Cavello | |
| 2002/0048739 | A1 | 4/2002 | Chu | |

FOREIGN PATENT DOCUMENTS

| | | | |
|---|---|---|---|
| DE | 4106059 | A1 * | 7/1991 |
| DE | 4313069 | A1 * | 10/1994 |
| DE | 19943699 | A1 * | 4/2001 |
| JP | 408031215 | A * | 2/1996 |

OTHER PUBLICATIONS

Dictionary.com/supporting.*
Dictionary.com/lenticular.*

* cited by examiner

*Primary Examiner*—Francis T. Palo
(74) *Attorney, Agent, or Firm*—Arthur Jacob

(57) ABSTRACT

A vessel provides a decorative display of a floral arrangement or like items utilizing a reservoir of liquid for providing visual effects, with the items placed within the reservoir and extending upwardly out of the reservoir, and a light source within an inner chamber surrounded by the reservoir, the walls of the reservoir being light-transmitting and the inner chamber being flared radially outwardly and upwardly to dissipate heat from the light source and to deflect the items radially outwardly away from the heat emanating from the light source.

8 Claims, 5 Drawing Sheets

LIGHT VASE

The present invention relates generally to the display of floral arrangements and like items and pertains, more specifically, to vessels in which such items are placed within a reservoir of liquid contained between light-transmitting walls for attaining aesthetic visual effects while protecting the items against heat generated by a light source provided by such a vessel.

Artists and designers have created an almost infinite variety of vessels for displaying floral arrangements and like items in a myriad of aesthetically pleasing constructions. In many of these constructions, artificial light is employed to enhance the display of natural items.

The present invention joins together a vessel for containing natural items, such as a floral arrangement, and a light source in a unique construction which provides aesthetically appealing visual effects while protecting the natural items from damage which otherwise could be caused by the presence of an artificial light source proximate the displayed items. As such, the present invention attains several objects and advantages, some of which are summarized as follows: Provides a vessel for displaying natural items, such as a floral arrangement, in concert with an artificial light source to establish a unique and aesthetically appealing display, while protecting the displayed items against damage from the light source; accomplishes a blending of natural and artificial elements in a pleasing display while promoting safety of the displayed elements; attains unique lighting effects in a vessel which displays floral arrangements and like items while preserving the natural beauty of the displayed items; provides a simplified construction for the display of floral arrangements and like items with increased ease and effectiveness.

The above objects and advantages, as well as further objects and advantages, are attained by the present invention which may be described briefly as a vessel for enabling a decorative display of floral arrangements and like items utilizing a reservoir of liquid for providing visual effects, with the items placed within the reservoir and extending upwardly out of the reservoir, the vessel comprising: an outer wall extending circumferentially around an essentially vertical axis and axially between a basal end and an uppermost rim spaced vertically above the basal end; and an inner wall extending circumferentially around the axis and spaced radially inwardly from the outer wall to establish an essentially annular container for containing the reservoir of liquid, up to a predetermined level, between the outer wall and the inner wall, the container including an opening between the rim and the inner wall such that items placed within the reservoir will extend upwardly through the opening; the inner wall extending axially between the basal end and an uppermost mouth spaced axially upwardly from the uppermost rim to establish an essentially annular upper vertical section in the inner wall extending vertically beyond the uppermost rim of the outer wall and an essentially annular lower vertical section, the upper vertical section being flared radially outwardly relative to the outer wall; the lower vertical section of the inner wall extending between the basal end and the upper vertical section and including an inner chamber coaxial with the container for the reception of a light source at a location vertically below the predetermined level of the reservoir of liquid; the outer wall and the inner wall being constructed of a light-transmitting material for transmitting light from the light source radially through the inner wall, the outer wall and the container between the inner wall and the outer wall, while the flared upper vertical section conducts heat from the chamber and from the container and dissipates the heat vertically above the opening to shield the opening, and any items extending through the opening, from the heat conducted from the chamber along the flared upper vertical section of the inner wall.

The present invention will be understood more fully, while still further objects and advantages will become apparent, in the following detailed description of preferred embodiments of the invention illustrated in the accompanying drawing, in which.

Figure 1:
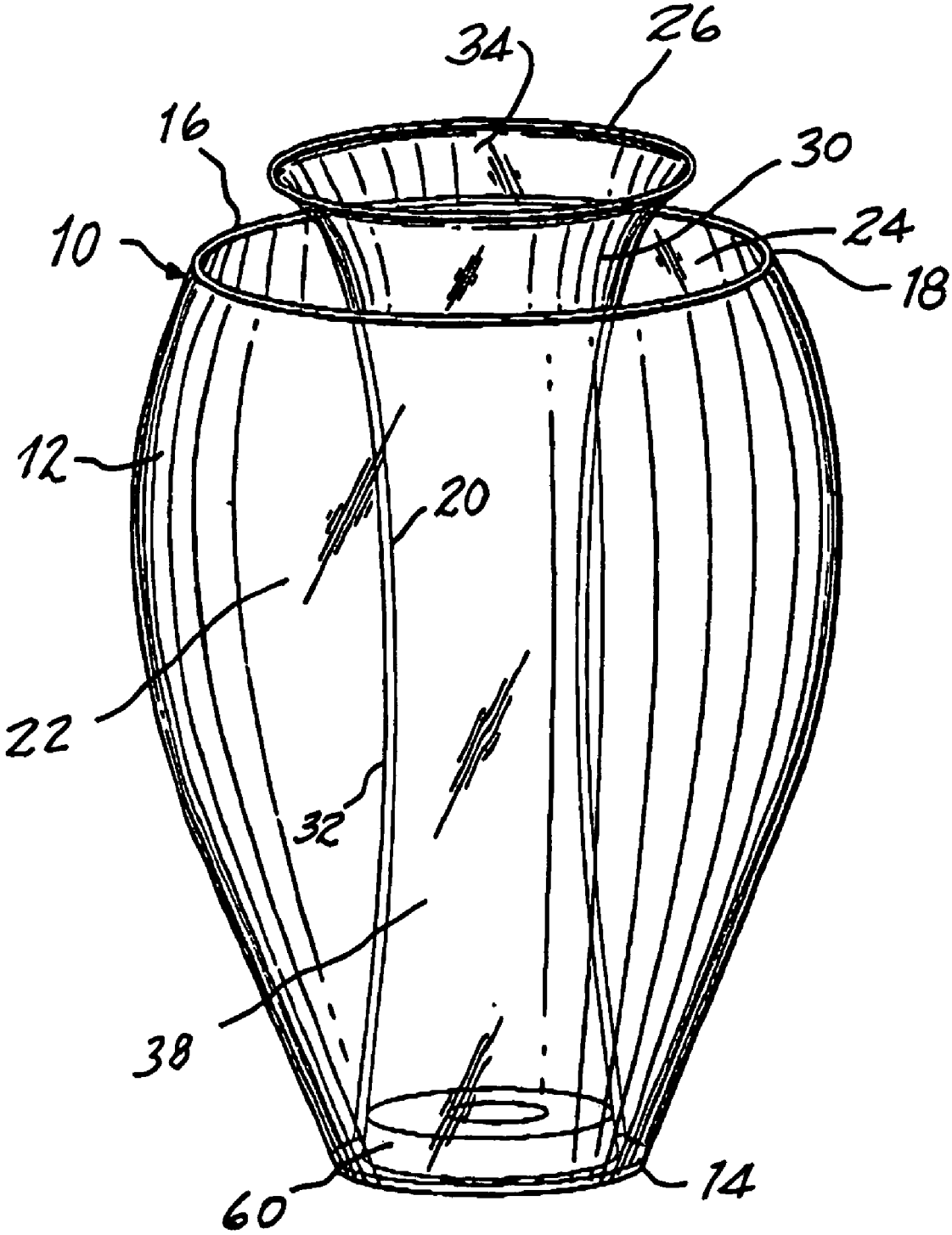
FIG. 1 is a top and front perspective view of a vessel constructed in accordance with the present invention.
Figure 2:
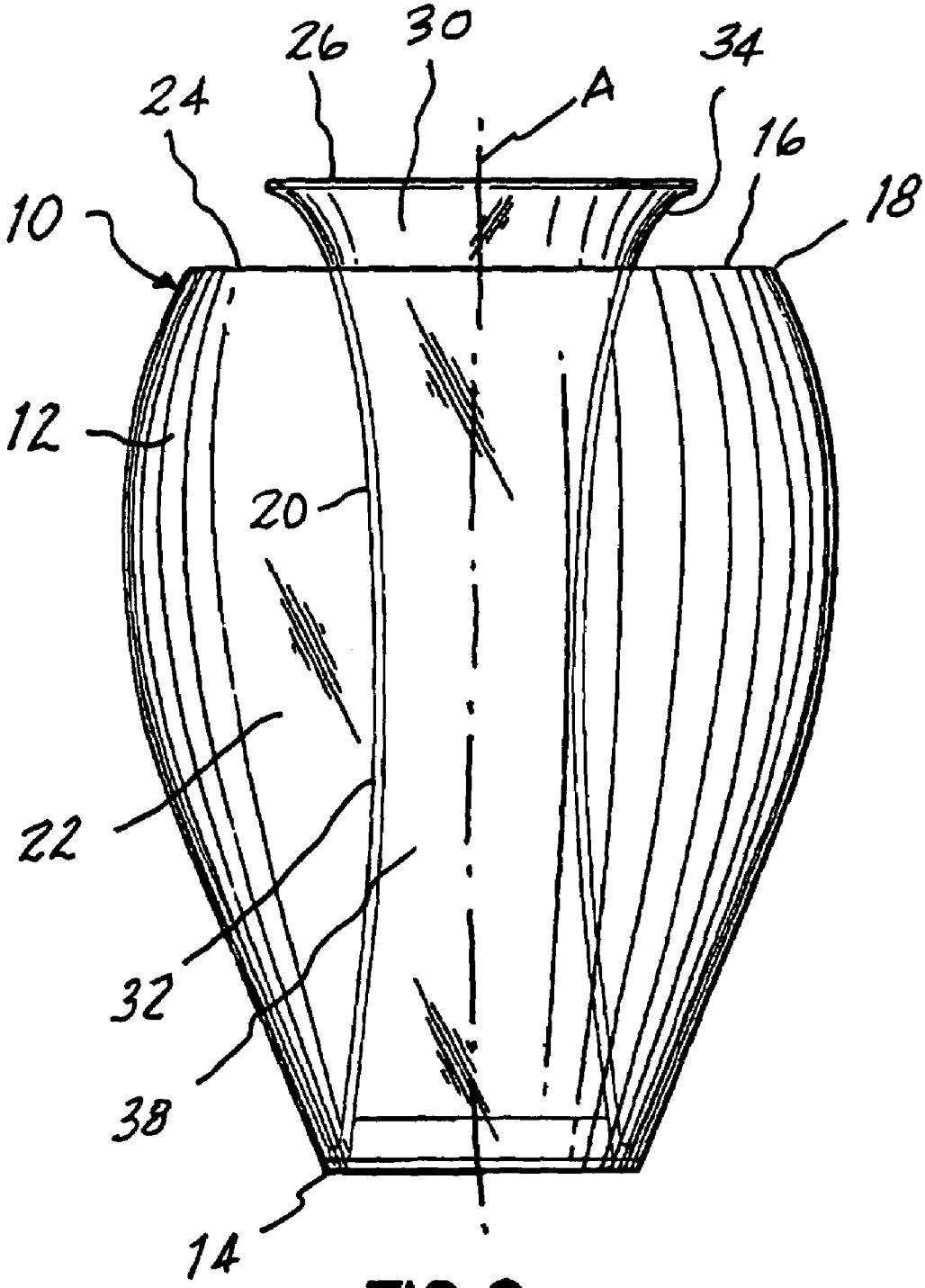
FIG. 2 is a front elevational view of the vessel.
Figure 3:
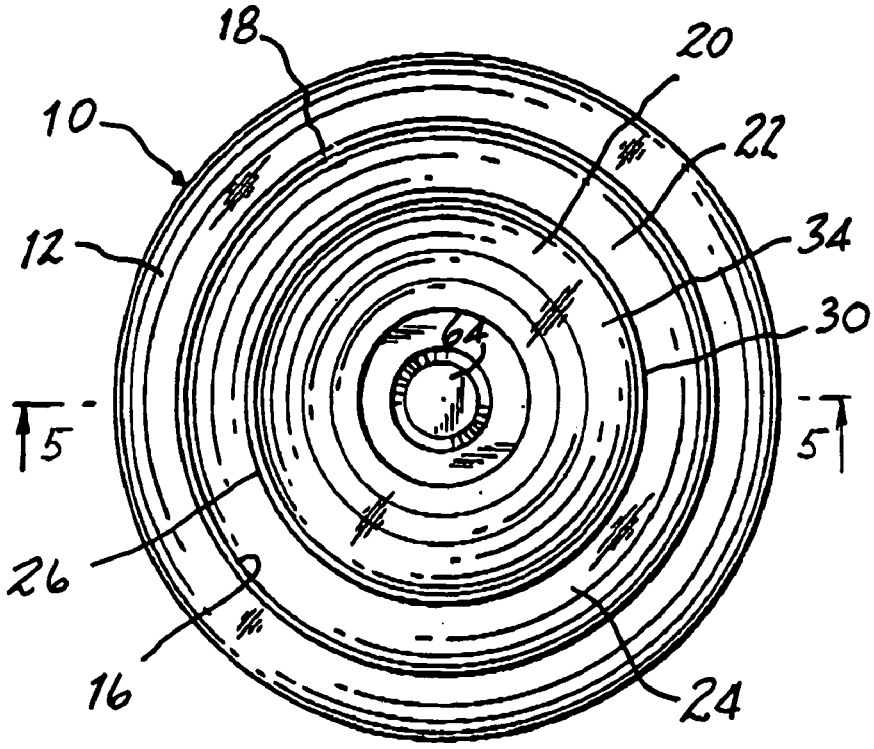
FIG. 3 is a top plan view of the vessel.
Figure 4:
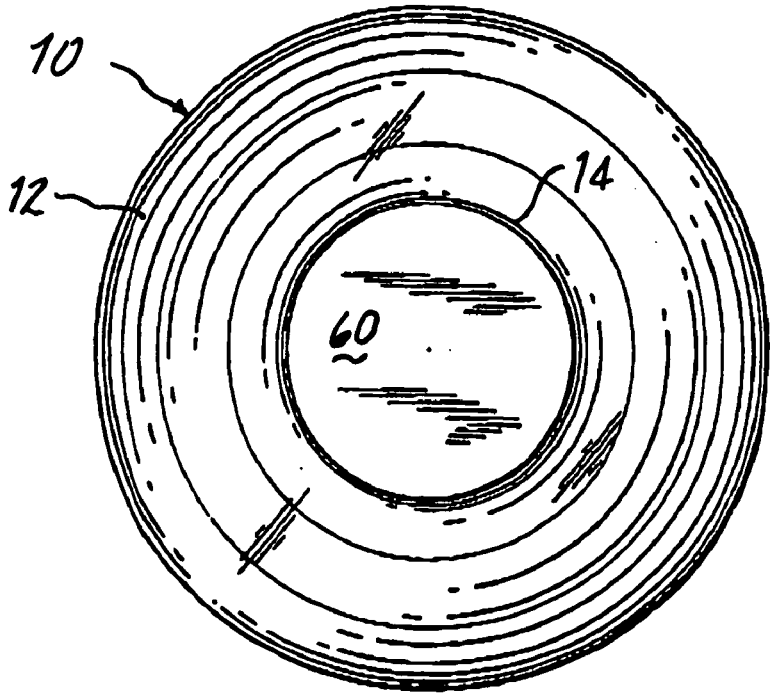
FIG. 4 is a bottom plan view of the vessel.

Referring now to the drawing, and especially to FIGS. 1 through 4 thereof, a vessel constructed in accordance with the present invention is illustrated generally at 10 and is seen to include an outer wall 12 extending circumferentially around an essentially vertical axis A and axially between a basal end 14 and an uppermost rim 16 at an uppermost end 18 such that the uppermost rim 16 is spaced vertically above the basal end 14. An inner wall 20 extends circumferentially around axis A and is spaced radially inwardly from the outer wall 12 to establish an essentially annular container 22 between the outer wall 12 and the inner wall 20, the container 22 including an opening 24 between the rim 16 and the inner wall 20.

The inner wall 20 extends axially between the basal end 14 and an uppermost mouth 26 which is spaced axially upwardly from the rim 16 to establish an essentially annular upper vertical section 30 in the inner wall 20, the upper vertical section 30 extending vertically beyond the rim 16 of the inner wall 20. An essentially annular lower vertical section 32 extends axially between the basal end 14 and the upper vertical section 30. The upper vertical section 30 is flared radially outwardly at 34 relative to the outer wall 12, and the lower vertical section 32 includes an inner chamber 38 which extends coaxial with the container 22, for purposes to be described more fully below.

Figure 5:
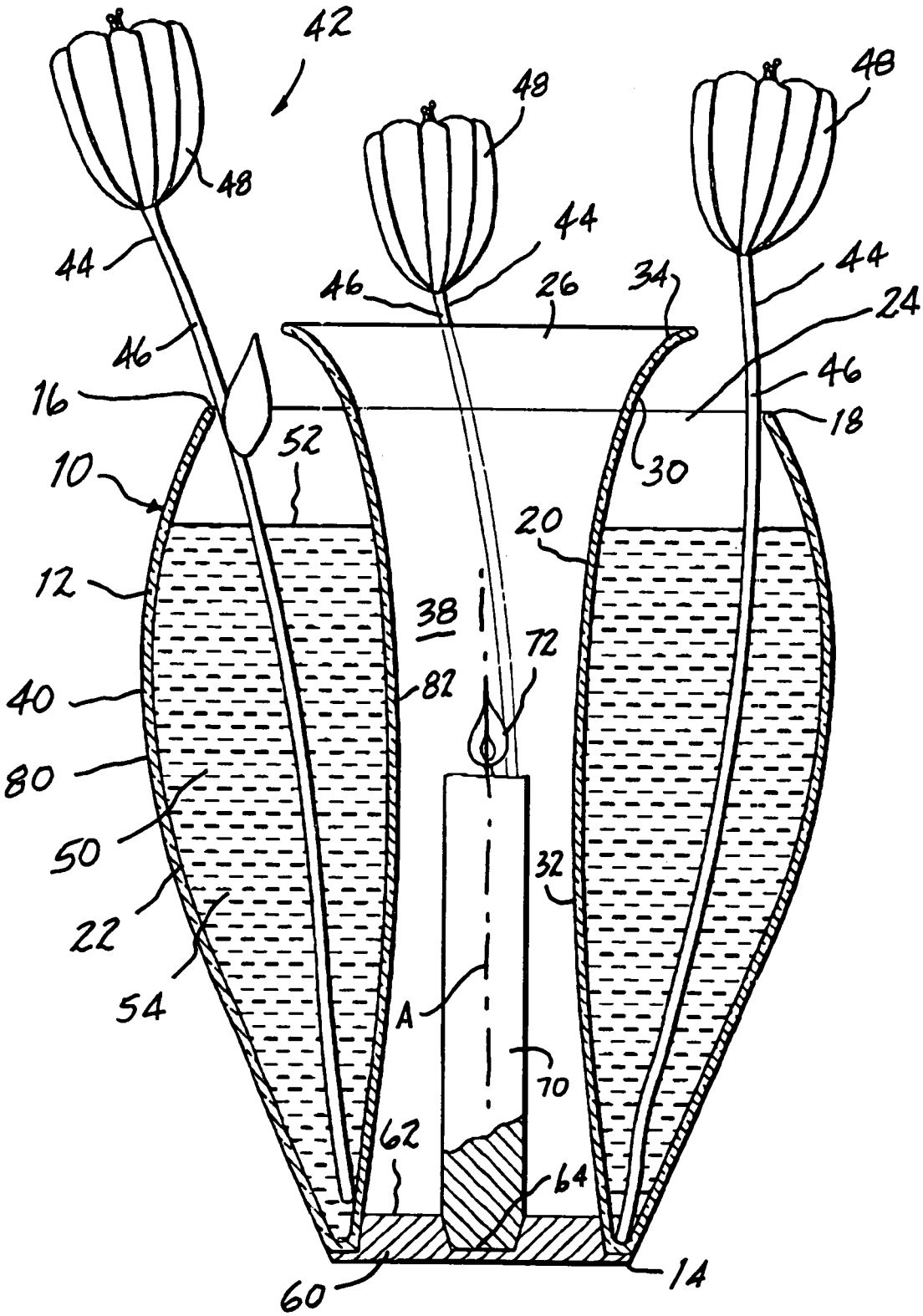
FIG. 5 is an enlarged cross-sectional view of the vessel, taken along line 5—5 of FIG. 3, and showing the vessel in use.

Turning now to FIG. 5, as well as to FIGS. 1 through 4, vessel 10 is shown being utilized as a vase 40 for the display of a floral arrangement 42 comprised of several flowers 44, each having a stem 46 and a blossom 48. Container 22 is filled with a liquid, shown in the form of water 50, up to a predetermined level 52 to establish a reservoir 54 of water 50 in the container 22. The stems 46 extend through opening 24 and into the reservoir 54, while the blossoms 48 are spaced above the vase 40.

In the illustrated embodiment, the outer wall 12 and the inner wall 20 are integral with one another and are placed upon a basal member in the form of base 60 which spans the chamber 38 at the basal end 14 and provides a platform 62 within the chamber 38 and a stable rest for the vase 40. A holder in the form of a socket 64 within the base 60 receives a light source illustrated in the form of a candle 70 which extends upwardly from the base 60 along the axis A to place a candle flame 72 intermediate the basal end 14 and the uppermost end 18, and well below the predetermined level 52 of water 50. The outer wall 12 and the inner wall 20 are constructed of a light-transmitting material, such as a transparent glass, so that light from the candle flame 72 passes through the inner wall 20, the water 50 in the reservoir 54, and the outer wall 12 to provide an aesthetic lighting effect in concert with the display of the floral arrangement 42.

In the preferred construction, the outer wall 12 includes a convex contour configuration 80 in vertical directions, while the inner wall 20 includes a concave contour configuration 82 in vertical directions so that the outer wall 12, the inner wall 20 and the water 50 in reservoir 54, between the outer wall 12 and the inner wall 20, function as a lenticular arrangement 84 enhancing the light emanating from the candle flame 72 and spreading the light to establish an effective and pleasing aesthetic effect. Heat generated by the candle flame 72 is conducted upwardly and effectively is dissipated by virtue of the flared configuration 34 of the upper vertical section 30 of the inner wall 20 which shields the flowers 44, as well as the opening 24, thereby protecting the flowers 44 from exposure to excessive heat. The flared configuration 34 extends over the opening 24 and further assures that the stems 46 of flowers 44 are deflected radially outwardly away from any excessive heat. Moreover, the effective dissipation of heat accomplished by the flared configuration 34 assures that the water 50 in reservoir 54 will not be heated excessively, thereby further promoting the safety of the flowers 44 for increased longevity.

Figure 6:
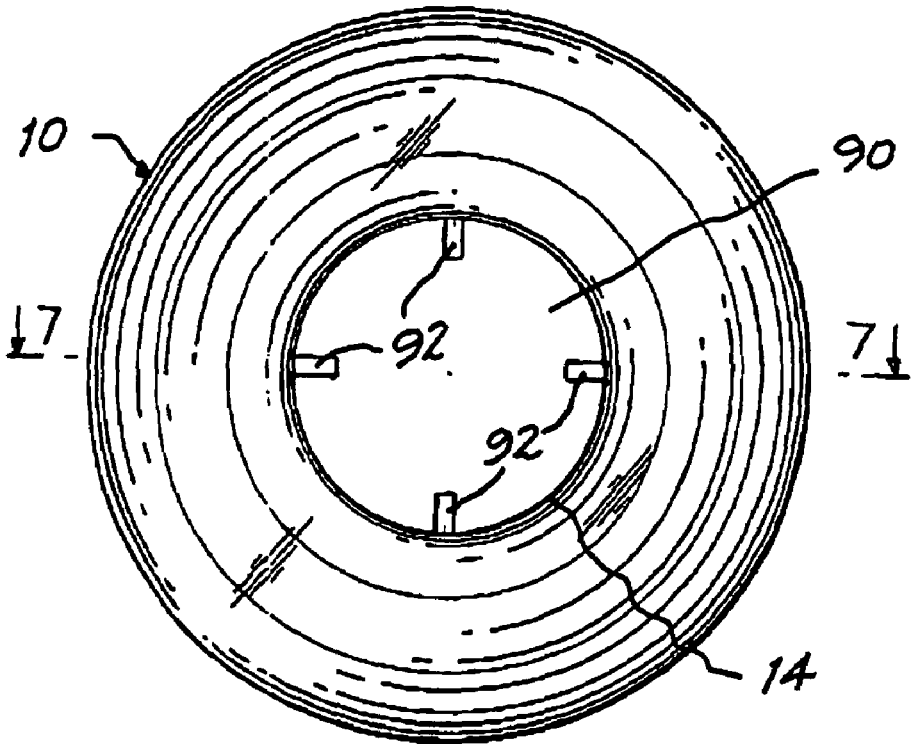
FIG. 6 is a bottom plan view of another vessel showing an alternate construction.
Figure 7:
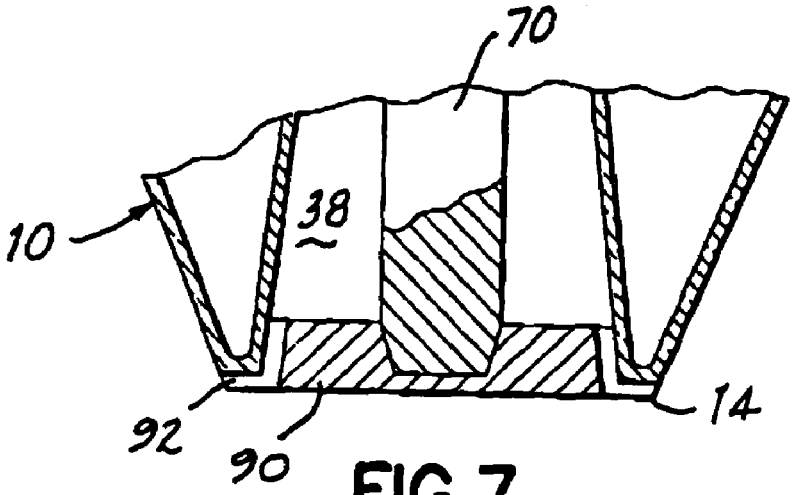
FIG. 7 is an enlarged fragmentary cross-sectional view taken along line 7—7 of FIG. 6.

Referring now to FIGS. 6 and 7, in an alternate construction, a basal member in the form of base 90 incorporates vent passages 92 spaced circumferentially around the base 90 and providing communication between inner chamber 38 the ambient surroundings such that outside air is drawn into the inner chamber 38 during burning of the candle flame 72 and enhances the dissipation of heat from the inner chamber 38 for further protection of the floral arrangement 42 against excessive heat.

It will be seen that the present invention attains the several objects and advantages summarized above, namely: Provides a vessel for displaying natural items, such as a floral arrangement, in concert with an artificial light source to establish a unique and aesthetically appealing display, while protecting the displayed items against damage from the light source; accomplishes a blending of natural and artificial elements in a pleasing display while promoting safety of the displayed elements; attains unique lighting effects in a vessel which displays floral arrangements and like items while preserving the natural beauty of the displayed items; provides a simplified construction for the display of floral arrangements and like items with increased ease and effectiveness.

It is to be understood that the above detailed description of preferred embodiments of the present invention is provided by way of example only. Various details of design and construction may be modified without departing from the true spirit and scope of the invention, as set forth in the appended claims.

The invention claimed is:

1. A vessel for enabling a decorative display of floral arrangements and like items utilizing a reservoir of liquid for providing visual effects, with the items placed within the reservoir and extending upwardly out of the reservoir, the vessel comprising:

an outer wall extending circumferentially around an essentially vertical axis and axially between a basal end and an uppermost rim spaced vertically above the basal end; and an inner wall extending circumferentially around the axis and spaced radially inwardly from the outer wall to establish an essentially annular container for containing the reservoir of liquid, up to a predetermined level, between the outer wall and the inner wall, the container including an opening between the rim and the inner wall such that items placed within the reservoir will extend upwardly through the opening;

the inner wall extending axially between the basal end and an uppermost mouth spaced axially upwardly from the uppermost rim to establish an essentially annular upper vertical section in the inner wall extending vertically beyond the uppermost rim of the outer wall and an essentially annular lower vertical section, the upper vertical section being flared radially outwardly relative to the outer wall;

the lower vertical section of the inner wall extending between the basal end and the upper vertical section and including an inner chamber coaxial with the container for the reception of a light source at a location vertically below the predetermined level of the reservoir of liquid;

the outer wall and the inner wall being constructed of a light-transmitting material for transmitting light from the light source radially through the inner wall, the outer wall and the container between the inner wall and the outer wall, while the flared upper vertical section conducts heat from the chamber and from the container and dissipates the heat vertically above the opening to shield the opening, and any items extending through the opening, from the heat conducted from the chamber along the flared upper vertical section of the inner wall; and a basal member at the basal end, the basal member supporting the vessel and including a platform within the inner chamber and adjacent the basal end.

2. The vessel of claim 1 wherein the outer wall includes a convex contour configuration along vertical directions, below the predetermined level, such that upon placement of liquid in the container, up to the predetermined level, between the lower vertical section of the inner wall and the outer wall, a lenticular configuration is established for acting in concert with the light source to provide a visual effect around the outer wall of the vessel.

3. The vessel of claim 2 wherein the inner wall includes a concave configuration along vertical directions adjacent the outer wall for enhancing the visual effect.

4. The vessel of claim 3 wherein the outer wall is transparent.

5. The vessel of claim 4 wherein the inner wall is transparent.

6. The vessel of claim 1 wherein the platform includes a holder for a candle.

7. The vessel of claim 1 wherein the basal member includes at least one vent passage extending from outside the vessel to the inner chamber.

8. The vessel of claim 7 wherein the platform includes a holder for a candle.

* * * * *